US005581963A

United States Patent [19]

Snair et al.

[11] Patent Number: 5,581,963

[45] Date of Patent: Dec. 10, 1996

[54] KNOCK DOWN ELEMENT WALL STRUCTURE

[76] Inventors: Robert W. Snair; Donald R. Snair, both of 2037 SE. Ochoco, Portland, Oreg. 97222

[21] Appl. No.: 409,753

[22] Filed: Mar. 24, 1995

[51] Int. Cl.[6] ..... E04B 1/38

[52] U.S. Cl. ..... 52/282.2; 52/282.4; 52/585.1; 292/152

[58] Field of Search ..... 292/152, 67; 52/282.1, 52/282.4, 585.1, 584.1, 211, 717.01, 718.02, 239, 282.2

[56] References Cited

U.S. PATENT DOCUMENTS

| | | | |
|---|---|---|---|
| 6,227 | 3/1849 | Arnold | 292/67 |
| 84,811 | 12/1868 | Farrar . | |
| 86,982 | 2/1869 | Goranflo | 292/67 |
| 162,000 | 4/1875 | Woolf | 292/67 |
| 266,601 | 10/1882 | Blayney . | |
| 570,503 | 11/1896 | Robertson | 292/67 |
| 886,853 | 5/1908 | Poulson . | |
| 1,159,877 | 11/1915 | Smith . | |
| 1,946,954 | 2/1934 | Ventura . | |
| 3,332,182 | 7/1967 | Mark | 52/584.1 |
| 3,787,134 | 1/1974 | Burr . | |
| 3,894,377 | 7/1975 | Welch | 52/584 |
| 4,395,856 | 8/1983 | Smith et al. | 52/239 |
| 4,881,764 | 11/1989 | Takahashi et al. . | |
| 5,121,950 | 6/1992 | Davidian | 292/164 |

*Primary Examiner*—Steven N. Meyers
*Assistant Examiner*—Donald J. Lecher
*Attorney, Agent, or Firm*—Eugene M. Eckelman

[57] ABSTRACT

Wall elements have edge cavities that extend inwardly through their side edge and have locking lugs inwardly of the cavities. Lock pins are provided between the wall elements for each cavity and are associated with the locking lugs for securely locking two wall elements together by moving the wall elements into edge-to-edge abutting relation. The cavities have a leveraging surface capable of pivoting the lock pins out of engagement with the locking lugs and thus disconnection of the wall elements upon relative vertical movement of adjacent wall elements. The invention is capable of assembling knock-down walled enclosures such as work spaces of substantially any size and shape.

14 Claims, 2 Drawing Sheets

FIG. 1
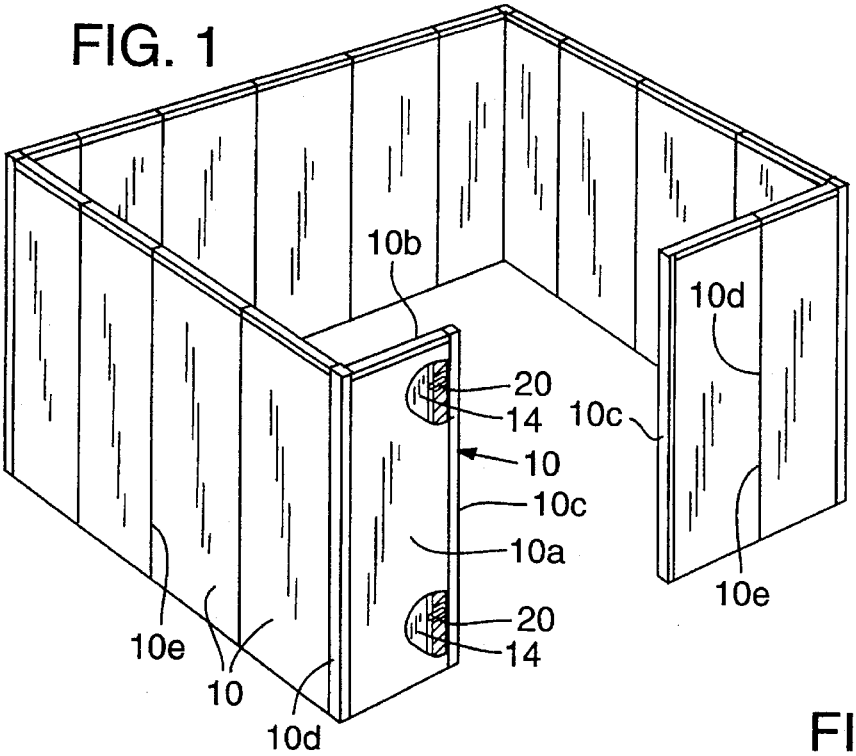
FIG. 5
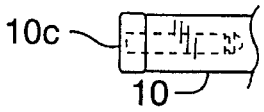
FIG. 6
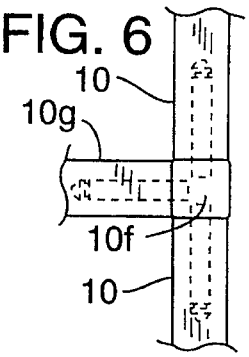
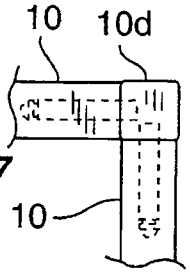
FIG. 7
FIG. 2
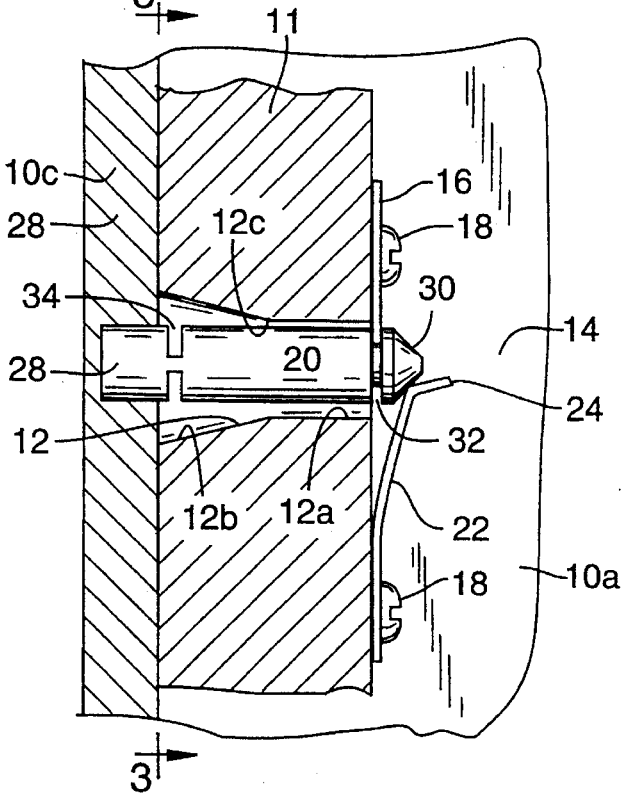
FIG. 3
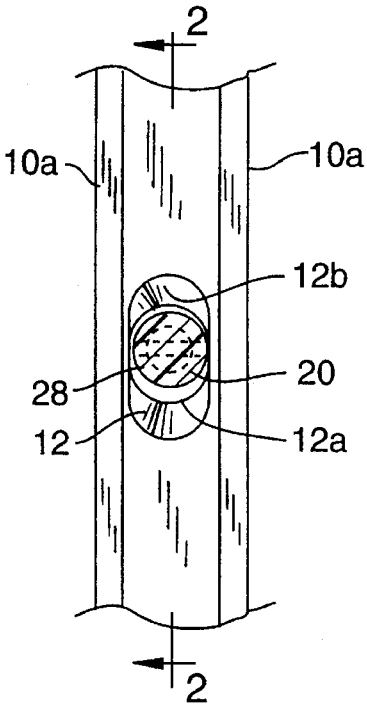

KNOCK DOWN ELEMENT WALL STRUCTURE

BACKGROUND OF THE INVENTION

This invention relates to a knock-down portable wall structure constructed of releasable wall elements.

It is often desired to construct enclosures within a room to define individual work spaces and the like. It is preferred that these enclosures be dismantleable rather than becoming a permanent part of the building. Various partitions have heretofore been known but do not possess all the features that are desired, namely, the use of wall portions that are attractive in appearance, that are rugged in construction, that have ease of assembly and disassembly, and that have versatility in shaping and sizing for an area to be enclosed.

SUMMARY OF THE INVENTION

An object of the invention is to provide a portable work space wall structure that overcomes deficiencies in prior devices in that it possesses all the features of being attractive in appearance, rugged in construction, easy to assemble and disassemble, and versatile in shaping the work space to be enclosed thereby.

A more particular object is to provide a wall structure of the type described that uses novel lock pins, associated lock cavities, and locking lugs that readily secure wall elements together in a positive manner without exterior connectors and also in a simplified manner. The lock means also provide ready disconnection for disassembly of the wall structure.

Yet another object is to provide a wall structure of the type described that is simplified in construction and inexpensive to manufacture.

In carrying out the objectives of the invention, cavities extend inwardly through the side edges of at least one of a pair of wall members in corner or edge trim elements of the wall structure and through both side edges of adjacent wall panel elements in wall expanse portions. In each case, lock pins are provided between the wall elements for each of the cavities and are associated with locking lugs in inner portions of the cavities that have snap-in locking engagement with the lock pins for securely attaching the two wall elements together. The cavities have a leveraging surface capable when engaged by the lock pins of pivoting them out of engagement with the locking lugs. Such leverage function is achieved by relative movement of two adjacent wall elements to cause the detachment of the two wall elements. In the corner or edge trim connections, the lock pin has one end secured to the corner or edge trim element at right angles thereto and its other end extends into the cavity for releasable locking association with the locking lug. In adjacent wall panel elements, double ended lock pins are used that have releasable locking connection at their opposite ends for securely attaching two wall panel elements together.

The invention will be better understood and additional objects and advantages will become apparent from the following description taken in connection with the accompanying drawings.

BRIEF DESCRIPTION OF THE DRAWINGS

FIG. 1 is a perspective view of a work space which can be readily formed by the present invention.

FIG. 2 is a fragmentary sectional view of a corner portion of a wall panel, this view being taken on the line 2—2 of FIG. 3 and showing a first form of lock pin in locked position.

FIG. 3 is a fragmentary elevational view of an edge of a wall panel, taken on the line 3—3 of FIG. 2.

FIGS. 5, 6 and 7 show assorted structural shapes at edge trim or corners of the wall panels.

DETAILED DESCRIPTION OF PREFERRED EMBODIMENTS

With particular reference to the drawings, and first to FIG. 1, the wall structure of the invention resides broadly in component wall panels 10 that can be combined in various ways to form inner work spaces of desired shapes and sizes. As an example, the panel system can be free standing or anchored to a wall or other structural member. FIG. 1 represents a simplified work space that can be readily formed by an assemblage of elements of the invention. Basic to the invention are the multiple wall panel elements 10 which have opposite surfaces 10*a*, also seen in FIG. 3, usually covered with a suitable attractive material having sound absorbent qualities. The panel elements 10 may be hollow core, acoustical core, or suitable other structure. A hollow core structure is illustrated structured with an interior frame 11. They have a top cap strip 10*b* and vertical narrow strip or trim elements 10*c* connected to those edges at doorways, wall ends, or other terminal edges. The edges of the panels at corners have connecting strip elements 10*d*. Wall elements 10*c* and 10*d* are secured releasably to the panels 10 by a single end lock pin, and adjacent edges 10*e* of wall panels in a wall surface are secured releasably by double end lock pins, to be described.

Figure 4:
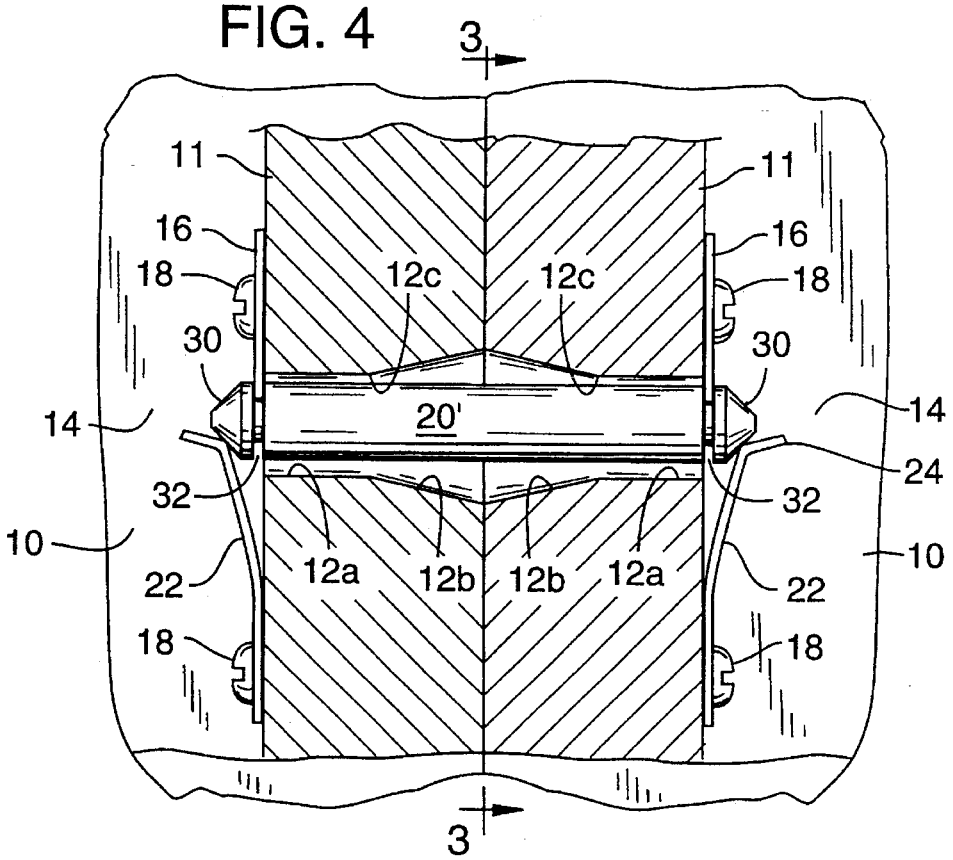
FIG. 4 is a fragmentary sectional view taken similar to FIG. 2 but showing a second form of lock pin, this view showing the pin in locked position.
Figure 4A:
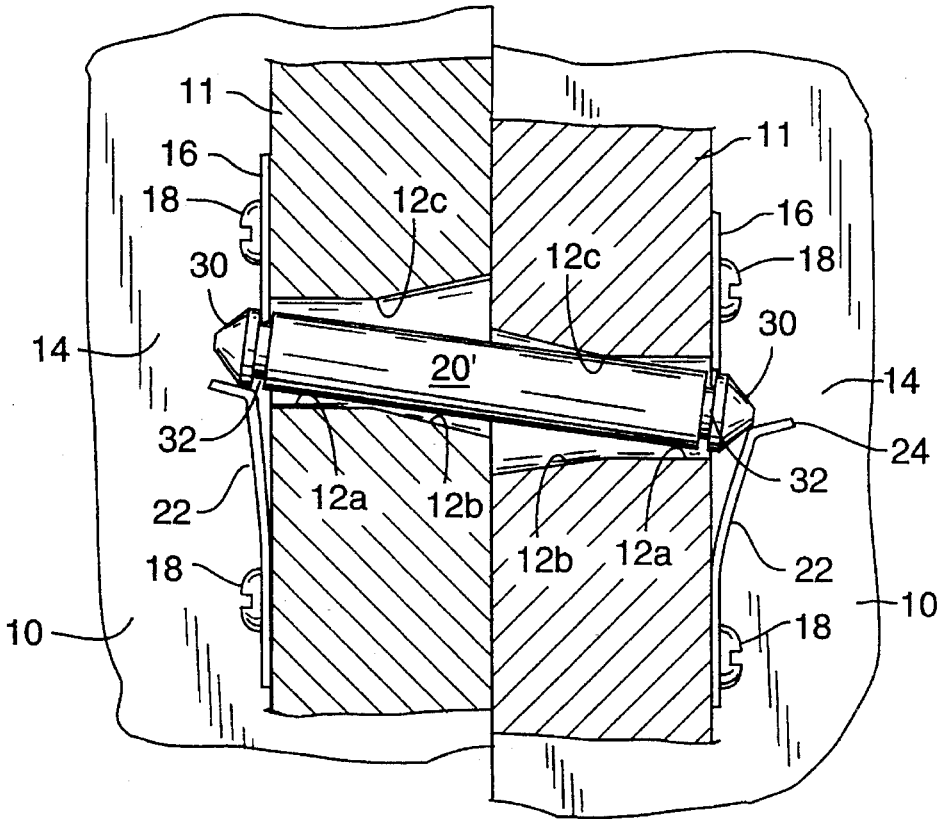
FIG. 4*a* is a view similar to FIG. 4 but showing the lock pin in the process of being unlocked.

Each wall panel element has a selected number of edge cavities 12, FIGS. 2, 3 and 4, that lead in through the side edges of the frame 11 adjacent the top and bottom thereof at right angles and that open interiorly in an enlarged recess or open area 14, also seen in FIG. 1. Two of such cavities adjacent the corners usually will suffice. The cavities 12 are vertically elongated in somewhat of an oval shape as seen in FIG. 3 at an inner portion 12*a* of the cavities. The top and bottom defining walls of cavity portion 12*a* are parallel with each other. An outer portion 12*b* thereof tapers to an enlarged dimension opening at the edge. The joining point 12*c* between wall portions 12*a* and 12*b* forms a fulcrum or leveraging point therebetween, as will be more apparent hereinafter. Fulcrum point 12*c* is approximately longitudinally centered in the cavity.

A rigid, thin locking lug 16 is secured integrally as by fastener means 18 to a wall of the recess 14 and in position to overlap the cavity 12 a short distance from the top of the cavity. As will be seen, lug 16 forms a catch for lock pins 20 and 20', FIGS. 2 and 4, respectively, and is associated with leaf spring retainers 22 that force the lock pins into a positive but releasable engagement with the locking lugs. The retainers 22 partially overlap the adjacent portion of the cavities and have angled ends 24 slidably engageable with the lock pins.

The FIG. 2 form of the lock pin, comprising a single end lock pin, is for securing an edge trim element 10*c* or corner element 10*d*, removably to the panels 10. The lock pin 20, FIG. 2, has a base end 28 that is securely fixed to trim element 10*c* for holding the lock pin at right angles to the element 10*c*. The lock pin has a tapered head end 30 that is engageable by the angled end 24 of the spring retainer 22 which firmly holds the pin upward toward the lug 16. The head end of the pin has a circumferential groove 32 in its body portion spaced a short distance from the tapered end 30. This groove is of a width that receives the lug 16 but at the same time with minimum play to prevent any substantial longitudinal play of the lug therein. A base portion of the lock pin adjacent its secured portion has top and bottom cross grooves 34 that weaken the body portion at this point to form a hinge that assists in separating the pin from the locking lug, to be described. The pin 20 is preferably round and has a diameter only slightly less than the width of the cavity 12 at the wall portion 12*a*, FIG. 3.

The FIG. 4 double end form of lock pin 20' is for releasably securing two wall panels 10 together in direct edge to edge engagement 10*e*. In this form, the lock pin also is round but has a head 30 on each end for locking engagement with locking lugs 16 in adjacent panels. The heads similarly have a circumferential groove 32 adapted for locking engagement with lugs 16, and the lock pins also have association with their respective cavities the same as was described in connection with pin 20.

The structure and dimension of the lock pins 20 and 20' are critical. They are formed of a material preferably plastic that is tough, substantially rigid in at least portions thereof so as to be capable of being operated as a lever. Also it is preferred to use a plastic that will not become brittle with age and that has a lubricating surface. The length dimension of the lock pins is such that when the single end structure of FIG. 2 has been inserted into cavity 12 to a point that substantially fully penetrates cavity portion 12*a*, the head end will ride over and snap into engagement with the lug 16. The pin then tightly holds the panel to the end trim element 10*c*. In the FIG. 4 double end structure, when the two opposite ends of the lock pin are fully inserted into their respective cavities, the heads engage the lugs of the two adjacent panels and the latter are held tightly together. In snapping the panels together as in FIG. 4 or connecting a panel to the edge strip 10*c* as in FIG. 2, it is merely necessary to move two of the members edgewise together such that the lock pins penetrate the cavity and snap into engagement with the lug 16. Spring retainers 22 ensure that the heads 30 obtain a positive lock connection as well as to hold the lock secure.

Cavity portions 12*a* are slightly larger vertically than the diameter of the lock pins. The pins thus have some vertical play but only minimal, for example, a fraction of an inch, top and bottom. Such vertical play is to allow proper locking of the lock pins to the lugs 16 as well as to allow unlocking thereof, to be described. The lateral dimension of the cavities, at both its portions 12*a* and 12*b*, is substantially the same as the diameter of the pins but with a slight clearance wherein the pin can be readily inserted but at the same time is fairly snug from side to side. Thus, there will be no appreciable side to side play of adjoining panels or of edge or connecting strip elements. In addition to vertical support of adjoining panels on a supporting surface for precise vertical alignment, the lock pins are firmly held in engagement with the lugs 16 by the retainers 22 and also prevent relative vertical movement.

To disconnect the trim element 10*c* of FIG. 2 from the panel 10 or corner 10*d* from a panel or to disconnect direct edge adjoining panels 10, FIG. 4, each of the lock pins 20 or 20' will release from its lug 16 when it is leveraged against the fulcrum point 12*c* of the cavity that is on the lug side of the lock pin. That is, in FIG. 2 for example, the strip 10*c* is detached by grasping it and forcing it upwardly relative to the panel 10 an amount sufficient to cause pin 20 to engage the top of the cavity and more particularly to engage the fulcrum point 12*c*. Continued movement of the strip 10*c* leverages the lock pin out of engagement with the lug 16 and strip 10*c* and pin are thus released. In view of the short length of pin 20, cut-out portions 34 provide sufficient hinge length distortion of the pin relative to its base to allow it to release from its lug 16. The lock pins in adjoining panels, FIG. 4, have similar leverage action in their release as do the lock pins 20 but do not require the intermediate hinge 34 as in FIG. 2.

With reference to FIGS. 5, 6 and 7, various arrangements of wall structures are available with the use of the instant invention. FIG. 5 illustrates an end trim element 10*c* on a panel 10, as detailed in FIG. 2. FIG. 6 illustrates a further arrangement of wall panel elements wherein a connecting member 10*f* has three usable sides such as for holding a partition wall 10*g*. FIG. 7 illustrates a corner element 10*d* also shown in FIG. 1. Such a corner member and the partition corner 10*f* are of a dimension to include lock pins 20 mounted on each of the angled surfaces therefor for releasably engaging panels in a manner similar to that of the trim element 10*c* in FIG. 2.

If desired, the top cap 10*b* can have a similar removable connection to the wall panels 10 as do the trim elements 10*c* or corners 10*d* and would be releasable from the wall panels by relative horizontal movement.

According to the invention, connector means are used that are concealed when in use. Also, these connector means are efficient in operation in that to connect members of the assembly, such members are merely moved together with a sufficient force to snap the pins 20 or 20' into engagement with the lugs 16. The connector parts are exact so that the various wall elements appear to be permanently attached. With the elements as disclosed herein, substantially any shape and size of area can be enclosed. Knock-down of an assembly is readily accommodated by the relative vertical movement of the elements as described.

It is to be understood that the forms of our invention herein shown and described are to be taken as preferred examples of the same and that various changes in the shape, size and arrangement of parts may be resorted to without departing from the spirit of our invention, or the scope of the subjoined claims.

Having thus described our invention, we claim:

1. A knock-down wall assembly comprising:

at least two wall members having upper and lower ends and upright confronting side edges, a horizontal cavity extending through at least one of said wall members, a stationary, vertical locking lug on the side edge of the said at least one of said wall members opposite the confronting side edge of the same said wall member and intersecting a portion of said cavity, a lock pin having securement at one of its ends to one of said wall members and extending inwardly at its other end into said cavity of said other wall member, said other end of the lock pin being configured for releasable locking engagement with said locking lug, and fulcrum leverage means in said cavity arranged upon relative vertical movement of said two wall members to be engaged by and to effect pivoting said lock pin to move said other end out of locking engagement with said lug to effect disconnection of said wall members.

2. The knock-down wall assembly of claim 1 wherein said fulcrum leverage means comprises an angled edge portion of said cavity between inner and outer portions of said cavity.

3. The knock-down wall assembly of claim 2 wherein said angled portion of said cavity is formed between an inner uniform dimension area of said cavity and an enlarged tapering outer portion thereof.

4. The knock-down wall assembly of claim 1 wherein said cavity is enlarged in its vertical dimension relative to the vertical dimension of said lock pin to provide vertical play of said lock pin in said cavity, and a spring retainer secured to the same wall member side edge as said lug and spaced vertically from and in the path of movement of said other end of said lock pin upon relative vertical movement of said wall members, to urge said lock pin into engagement with said locking lug.

5. The knock-down wall assembly of claim 1 wherein said cavity is enlarged in its vertical dimension relative to the vertical dimension of said lock pin to provide vertical play of said lock pin in said cavity, said other end of said lock pin having a head with a tapered end surface and a notch adjacent said head end, said notch being engageable by said locking lug in a locked engagement of said lock pin, and a spring retainer secured to said wall member vertically spaced from said lug and in the path of movement of said head end surface to urge said lock pin into engagement with said locking lug upon inward movement of said lock pin.

6. The knock-down wall assembly of claim 5 including a recessed area interior of said wall member at the inner end of said cavity for receiving said locking lug, said spring retainer, and the head end of said lock pin.

7. The knock-down wall assembly of claim 1 wherein one of said two wall members comprises a wall panel with said cavity therein and the other of said wall members comprises an edge trim member with said lock pin secured thereto at its said one end.

8. The knock-down wall assembly of claim 1 wherein one of said two wall members comprises a wall panel with said cavity therein and the other of said two wall members comprises a corner member connected angularly to another wall member.

9. A knock-down wall assembly comprising:

at least two wall members having upper and lower ends and upright confronting side edges, a horizontal cavity extending through each wall member in horizontal alignment, a stationary vertical locking lug on each side edge opposite the confronting side edge and intersecting a portion of said cavities, a lock pin having opposite ends extending into respective cavities, said opposite ends of said lock pin having vertical locking engagement with respective locking lugs, and fulcrum leverage means in said cavities arranged upon relative vertical movement of said two wall members to be engaged by and to effect pivoting of said lock pin for disengagement from selected ones of said locking lugs to effect disconnection of said wall members (one) from the other.

10. The knock-down wall assembly of claim 9 wherein said fulcrum leverage means comprises an angled edge portion of at least one of said cavities between inner and outer portions of said cavity.

11. The knock-down wall assembly of claim 10 wherein said angled portion of said cavity is formed between an inner uniform dimensioned area of said cavity and an enlarged tapering outer portion thereof.

12. The knock-down wall assembly of claim 9 wherein each cavity is enlarged in its vertical dimension relative to the vertical dimension of said lock pin to provide vertical play of said lock pin in said cavity, and a spring retainer secured to said wall member vertically spaced from said lug and in the path of movement of said lock pin upon relative vertical movement of said wall members to urge said lock pin into engagement with said locking lug.

13. The knock-down wall assembly of claim 9 wherein each cavity is enlarged in its vertical dimension relative to the vertical dimension of said lock pin to provide vertical play of said lock pin in said cavity, each of said opposite ends of said lock pin having a head with a tapered end surface and a notch adjacent said head end, said notch being engageable by said locking lug in a locked engagement of said lock pin, and a spring retainer secured to said wall member vertically spaced from said lug and in the path of movement of said head end surface to urge said lock pin into engagement with said locking lug upon inward movement of said lock pin.

14. The knock-down wall assembly of claim 13 including a recessed area interior of each wall member at the inner end of said cavity for receiving said locking lug, said spring retainer, and the corresponding head end of said lock pin.

* * * * *